United States Patent [19]

Hutchinson et al.

[11] 4,353,229

[45] Oct. 12, 1982

[54] WEFT KNITTED FABRIC

[75] Inventors: William Hutchinson, Leicester, England; Klaus L. P. Wermelt, Greven, Fed. Rep. of Germany

[73] Assignee: Wildt Mellor Bromley Limited, Great Britain

[21] Appl. No.: 85,420

[22] Filed: Oct. 16, 1979

Related U.S. Application Data

[63] Continuation-in-part of Ser. No. 856,208, Nov. 30, 1977, abandoned.

[30] Foreign Application Priority Data

Dec. 1, 1976 [GB] United Kingdom ..... 50015/76

[51] Int. Cl.[3] ..... D04B 9/06

[52] U.S. Cl. ..... 66/197; 66/20; 66/27; 66/198

[58] Field of Search ..... 66/190, 196, 197, 198, 66/199, 200

[56] References Cited

U.S. PATENT DOCUMENTS 951,033 3/1910 Steber ..... 66/200 X
1,386,444 8/1921 Stibbe ..... 66/190

FOREIGN PATENT DOCUMENTS 1440932 4/1966 France ..... 66/196
1030674 5/1966 United Kingdom ..... 66/196
1552231 12/1979 United Kingdom ..... 66/197
299580 7/1971 U.S.S.R. ..... 66/198

OTHER PUBLICATIONS

*Knitting Times*, Sep. 13, 1971, vol. 40, No. 38, pp. 67 through 73.

*Knitting Times*, Sep. 23, 1974, vol. 43, No. 39, pp. 73 through 78.

*Primary Examiner*—Wm. Carter Reynolds

*Attorney, Agent, or Firm*—Robert E. Burns; Emmanuel J. Lobato; Bruce L. Adams

[57] ABSTRACT

Weft double knitted fabric has a looped structure with some knitted loops drawn in one direction and other knitted loops drawn in an opposite direction. Yarns of some courses are drawn into knitted loops in both directions to form knit stitches on both faces of the fabric. Yarns of other courses are drawn into knitted loops in a first direction only to form knit stitches on one face only of the fabric. Yarns of still other courses are drawn into knitted loops in the second direction only to form knitted stitches on the other face only of the fabric. An inlay yarn is formed exclusively into tuck stitches extending in both directions, with different yarns drawn through the tuck stitches to form knit stitches on opposite faces of the fabric.

1 Claim, 6 Drawing Figures

WEFT KNITTED FABRIC

REFERENCE TO PRIOR APPLICATION

This application is a continuation-in-part of our application Ser. No. 856,208, filed Nov. 30, 1977 and now abandoned.

REFERENCE TO PRIOR APPLICATION

The invention relates to knitting, particularly on machines of the cylinder and dial type having a large number of yarn feeding stations.

A large variety of double jersey fabrics can be made on these machines, including jacquard, patterned relief or cloque stitch and a variety of fabrics incorporating inlaid yarns.

This invention provides an improved knitted fabric having inlaid yarns which are locked into the knitted structure to minimize weft-wise stretch. These fabrics are particularly useful for making up into suits because the 'locked in' inlay yarns help to provide the stability and 'body' which is needed in this type of garment. Fabrics according to the invention can be made according to a variety of knitted patterns and structures. Basically, on a cylinder and dial circular knitting machine for example patterning is possible by selecting those cylinder and dial needles which knit and tuck at successive feeds. Selection of needles in the cylinder can be achieved by patterning means such as patterning drums and discs, and selection of needles in the dial can be obtained by using different heights of butts for controlling the needles.

In the production of a fabric according to the invention the selection of the cylinder and dial needles is usually according to a simple pattern such as 1/1 in both cylinder and dial. In other words, alternate needles only in both beds are selected during a knitting sequence taking place over, for example, four feeding stations. It is usual, also, to reverse the selection at the next four feeding stations so that the intermediate needles only in both beds are activated. This reversal of the selection continues throughout each consecutive set of four feeding stations around the knitting circle, and provides a fabric that is particularly suitable for use as a men's suiting material.

Fabric produced in accordance with such a four course sequence, with reverse selection giving an overall eight course sequence, can have a bird's eye type structure and appearance and is well known. However, in the known fabrics the inlay yarn has been previously simply laid into the hooks of both sets of needles at a feed and cast off the needles at the following feed (together with the ground yarn) in the form of tuck loops. This method of locking the inlay yarn has not been very satisfactory for the following reason. Because the inlay yarn is fed into the hooks of the cylinder and dial needles the yarn is drawn into loops by the cylinder needles as they pass below the stitch cam. This action causes the tuck loop course of the inlay yarn to be slack and it therefore fails to exert sufficient weft-wise restraint on the fabric. The present invention seeks to provide a knitted fabric structure in which the 'body' of the fabric and weft-wise stretch can be controlled within much narrower limits than heretobefore.

The fabric of the invention can be knitted on V-bed flat and cylinder-and-dial circular knitting machines, although for convenience and for the purpose of illustration the following description is confined to cylinder-and-dial circular knitting machines.

The invention provides weft double knitted fabric having a looped structure comprising knitted loops in wales of which some wales have their loops drawn exclusively in a first direction and the other wales have their loops drawn exclusively in a second direction opposite to the first, wherein yarns of some courses are drawn into knitted loops in both directions to form knit stitches on both faces of the fabric; yarns of other courses are drawn into knitted loops in the first direction only to form knit stitches on one face only of the fabric; and an inlay yarn is formed exclusively into tuck loops extending in both directions, with the yarns that are drawn through the tuck loops to form knit stitches on the said one face of the fabric being yarns of courses other than those that are drawn through the tuck loops to form knit stitches on the other face of the fabric. One such fabric according to the invention comprises:

a first yarn drawn into knitted loops at selected wales, the loops of the same course of said first yarn extending to both faces of the fabric;

a second yarn drawn into knitted loops at selected wales other than those selected for the first yarn, the loops of the same course of the said second yarn extending to both faces of the fabric;

a third yarn drawn into knitted loops at selected wales, the loops of the same course of said third yarn extending to the first face only of the fabric;

a fourth yarn drawn into knitted loops at selected wales, the loops of the same course of said fourth yarn extending to the second face only of the fabric; and a fifth yarn tucked at selected wales in those of the knitted loops of said first yarn which extend to only one of said first and second faces of the fabric and in those of the knitted loops of said second yarn which extend to only the other of said first and second faces of the fabric, the selection of the wales at which the various knitted and tuck loops are formed being in accordance with any desired pattern requirement.

The particular sequence of tucking the fifth yarn, which is the inlay yarn, in the stated manner is achieved by feeding the inlay yarn from beneath the latch guard to the hooks of the projected dial needles and around the stems of the projected cylinder needles at clearing height, and controlling the retraction of the dial needles so that the inlay yarn is drawn around the stems of the projected cylinder needles prior to being cast off the dial needles as tuck stitches in a subsequent knitting movement of the dial needles (i.e. at a subsequent knitting station). A fabric according to the invention incorporates a unique arrangement of tuck stitches in a double knit fabric. A tuck stitch is one that comprises a held loop, and a tuck loop through both of which is drawn a knitted loop. In a fabric according to the invention the knitted loops of each row of tuck stitches are drawn as two separate courses, with the yarns that are drawn through the tuck loops and held loops to form the knit stitches on one face of the fabric being yarns of courses other than those that are drawn through the tuck loops and held loops to form the knit stitches on the other face of the fabric. To create a fabric in this way it is necessary to complete the tuck stitches, by drawing knitted loops through the tuck loops and held loops, in two discrete stages, spread over two yarn feeding stations. This is possible if the inlay yarn is tucked around the stems of the needles of one bed and in the hooks of the needles of the other bed. The tuck stitches are completed on the needles of the one bed at a first yarn feeding station and on the needles of the other bed at a subsequent yarn feeding station. By controlling the retraction of the needles of the other bed while they hold the tuck loops in their hooks, the body and stretch characteristics of the resulting fabric can be controlled within wide limits.

Relating the above general description to a typical example of knitting on a cylinder and dial circular knitting machine, it will be appreciated that as in conventional knitting, selected ones of the cylinder and dial needles can be projected to permit patterning variations. For example more than one yarn can be drawn into knitted loops by both cylinder and dial needles to form knit stitches on both faces of the fabric. This can be achieved by feeding one such yarn to alternate cylinder needles and alternate dial needles and feeding the other such yarn to intermediate cylinder needles and intermediate dial needles. The inlay yarn need be fed only every four or eight feeding stations to provide a fabric that has a considerable improvement in body and resistance to weft-wise stretch.

The body and stretch characteristics of the fabric can be controlled within a wide range by varying the controlled retraction of the dial needles to draw the inlay yarn for different extents around the stems of the projected cylinder needles. This can be achieved using an adjustable mounting for a cam of the dial cam-plate of the machine.

Such an adjustable cam mounting comprises a block for mounting the cam, location means mountable on the dial cam-plate of the knitting machine and means for adjusting the block radially of the location means. The means for adjusting the block radially of the location means preferably comprises a screw, cam or other fine adjustment. A convenient cam adjustment is provided by an eccentric spigot on a location shaft, engaging opposite sides of a transverse slot in the block.

The inlay yarn is fed through a combined yarn feeder and latch guard which comprises a first yarn guide passage for feeding yarn from a trailing edge of the latch guard and a second yarn guide passage for feeding the inlay yarn from the bottom of the latch guard at or near the leading edge thereof directly to the hooks of the dial needles. Preferably the second yarn guide passage extends down into the dial needle hooks, so as to ensure accurate yarn placement, in which case other parts of the bottom of the latch guard must be at a higher level to avoid fouling by the hooks of the dial needles.

The invention is hereinafter particularly described, by way of example only, with reference to the accompanying drawings. In the drawings.

Figure 1:
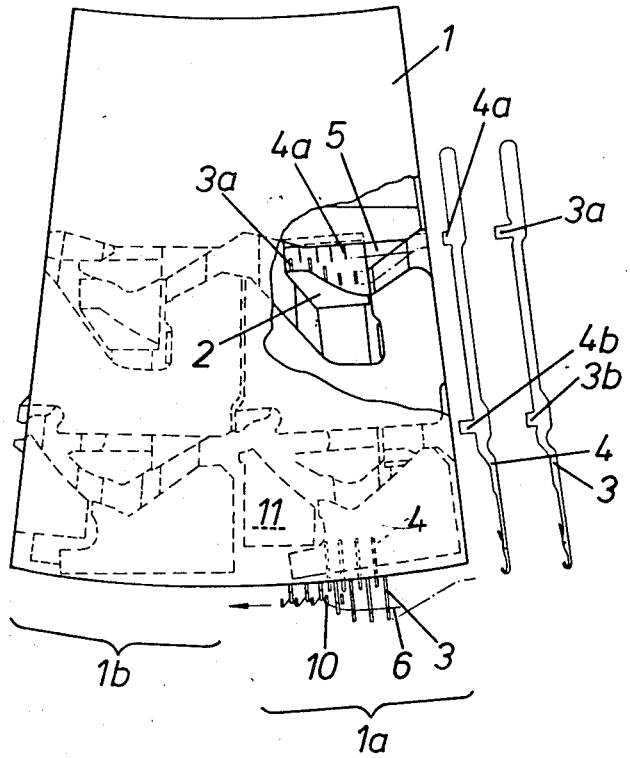
FIG. 1 is a plan view of part of the dial cam-plate of a knitting machine arranged to knit fabric according to the invention, the Figure spanning two feeding stations, partly cut away to show an adjustable cam.
Figure 5:
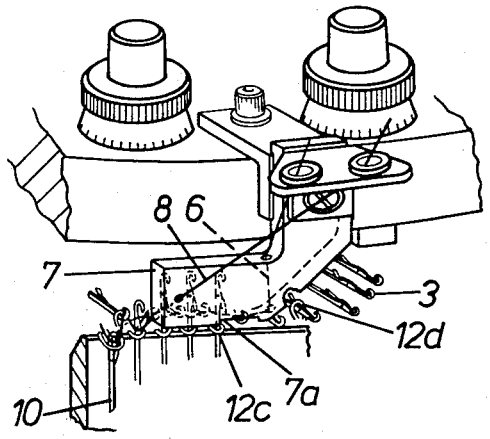
FIG. 5 is a perspective view of a part of the knitting machine showing the yarn feeder attached to the dial cam-plate.

A segment 1 of the dial cam-plate shown in FIG. 1 is equipped with two sets, 1*a* and 1*b*, of cams, each set constituting a knitting section of which there can be 48 in a complete dial cam-plate. The set 1*a* has a cam 2 which is adjustable radially. Needles 3 and 4 are shown, each having controlling nuts 3*a*, 3*b*, 4*a* and 4*b* of different lengths. A cam 5 is fixed in the cam-plate and is of such a level that it will engage only long butts such as 3*a* while allowing short butts such as 4*a* to pass by over its surface. As can be seen in FIG. 1 the long butts 3*a* on alternate needles are being directed onto the adjustable cam 2 while the short butts 4*a* on intermediate needles 4 are not so directed. Thus, every other dial needle is projected to take an inlay yarn fed at the knitting station covered by the cam set 1*a*. The action of feeding the yarns is shown in FIG. 5 where the inlay yarn 6 is shown passing through the feeder plate 7 to the projected dial needles 3 while the ground yarn 8 is shown passing through the same feeder plate 7 to alternate cylinder needles 10. For clarity the intermediate dial needles 4 are not shown in FIG. 5, and the intermediate cylinder needles are not shown at all.

The needles move from right to left from the positions shown in FIGS. 1 and 5 and the dial needles 3 are retracted by the adjustable cam 2 so that they do not take the ground yarn 8.

As can be seen in FIGS. 1 and 5, the retracting of the dial needles 3 causes the inlay yarn 6 to be pulled inwardly around and between the cylinder needles 10 below the needle latches and adjacent the previously knitted ground yarn loops 12*c* on the cylinder needles 10. The loops 12*c* and the kinked inlay yarn 6 wrapped around the cylinder needles 10 are subsequently cast over the head of the cylinder needles at the stitch cam.

Considering the action which has just been described, it can be seen that the inlay yarn 6 has been taken into the hooks of the dial needles 3 and added to ground yarn loops 12*d* on the dial needles which have been knitted at a previous section and are holding the latch open. The inlay yarn 6 will thus be cleared, together with the ground yarn loops 12*d* at a subsequent section and cast off as tuck stitches. The inlay yarn 6, kinked around the cylinder needle stem below the latch will be cast off the needle 10 as a tuck stitch in the adjacent ground yarn loop 12*c*.

An important advantage obtained by practising this method of knitting is that by adjusting the radial position of the cam 2 of FIG. 1, the amount of 'draw' by the dial needles on the inlay yarn 6 to kink it around the cylinder needle stems can be varied, and because the inlay yarn is fed at a level below the open latches of the cylinder needles it is cast off without ever entering the hooks of those needles. The inlay yarn can therefore be maintained under greater control than heretobefore and the tuck loops produced by the dial needles effectively lock the yarn in the fabric.

Figure 2:
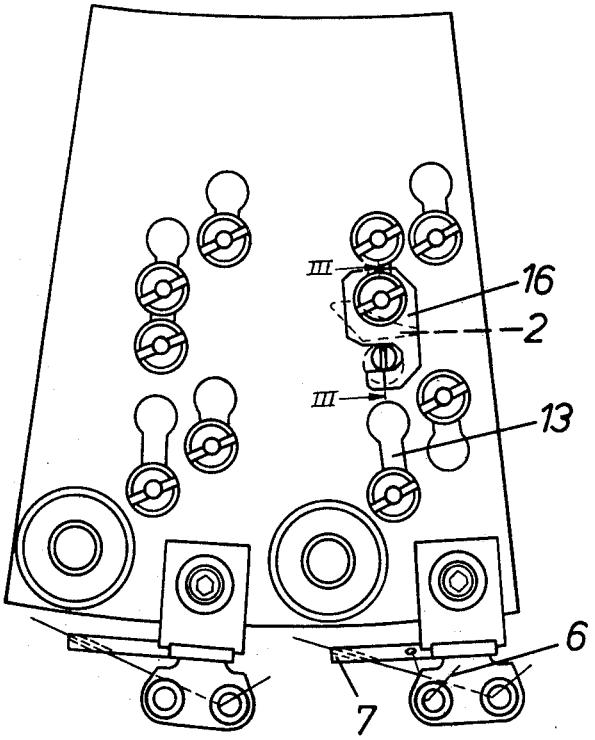
FIG. 2 is a similar view of the cam-plate but showing the cam fixing means.
Figure 3:
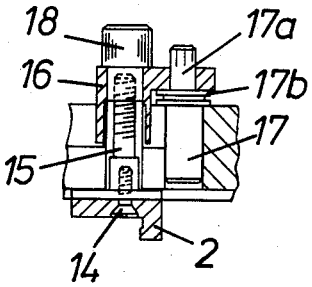
FIG. 3 is a section taken long the line III—III in FIG. 2.
Figure 4:
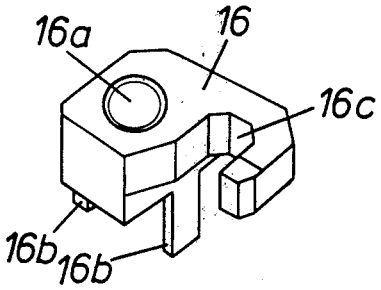
FIG. 4 is a perspective view of the cam adjuster shown in FIGS. 2 and 3.

For the adjustment of the dial needle cam 2 of FIG. 1 a special device is secured to the cam plate. This device is shown in FIGS. 2,3 and 4 and one of its features is that it can be attached to the cam-plate without necessitating any modification of the plate. Conventional 'keyhole' slots such as 13 of FIG. 2 are provided in the cam-plate for the purpose of moving cams from one position to another for the purpose of altering the character of the fabric. The slots allow the cam and its fixing screw to be moved and tightened up without removing the camplate and previously the cam 2 has been capable of being secured in either one of two fixed radial positions. In the present embodiment the cam 2, as shown in FIG. 3, complete with its screw 14 and locking screw 15, is mounted in an adjustable block 16. The block 16, as can be seen in FIG. 4, has a hole 16*a* for locating the locking nut 18 and a pair of tenons 16*b* for locating the block in the keyhole slot of the cam-plate. The block has also a transverse slot 16*c* in which is located a post or spindle 17 (FIG. 3) having a grooved shoulder 17*b*. The post 17 is located in a hole of the 'keyhole' slot with its shoulder 17*b* flush with the top surface of the cam-plate. Its eccentric spigot 17*a* is located in the transverse slot 16*c* of the adjustable block 16 and by turning the post in the plate, using a screwdriver in a slot in the spigot, the block 16 complete with its cam 2, can be caused to slide in the 'keyhole' slot to an extent governed by the degree of eccentricity of the spigot 17*a*. The whole assembly is locked in the desired position after adjustment by tightening the nut 18 on the locking screw 15.

To facilitate fine adjustment, the eccentric spindle 17*a* may be calibrated and a datum line suitably marked on the block 16.

The yarn feeder plate 7 of FIG. 5 is designed in such a way that the inlay yarn 6 is guided into the hooks of the dial needles 3 but kept clear of the hooks of the cylinder needles 10.

In order to feed the inlay yarn 6 at a level low enough for it to be taken into the hooks of the dial needles as they are retracted by the cam 2, the feeder plate 7 is positioned lower than normal and a groove 7*a* is made in its bottom edge to allow the hooks of the needles 3 to pass from radially outwardly of the feeder plate to the inside as shown in FIG. 5.

The knitting machine illustrated in the drawings may be provided with an inlay station such as 1*a* every fourth knitting station, alternate inlay stations 1*a* actuating alternate and intermediate needles respectively by virtue of the high and low butts 3*a*, 3*b*, 4*a* and 4*b*. A typical double knit fabric structure might be:

lst feeding station: alternate cylinder needles and alternate dial needles knit a first yarn;

2nd feeding station: intermediate cylinder needles and intermediate dial needles knit a second yarn;

3rd feeding station: all cylinder needles miss and alternate dial needles knit a third yarn;

4th feeding station: alternate cylinder needles knit a fourth yarn and tuck a fifth, inlay, yarn and intermediate dial needles take the inlay yarn in their hooks as stitches tucked in with the held second yarn;

5th to 8th feeding stations: repeat the sequence of the 1st to 4th feeding stations, selecting intermediate needles in place of the alternate needles and vice versa.

Figure 6:
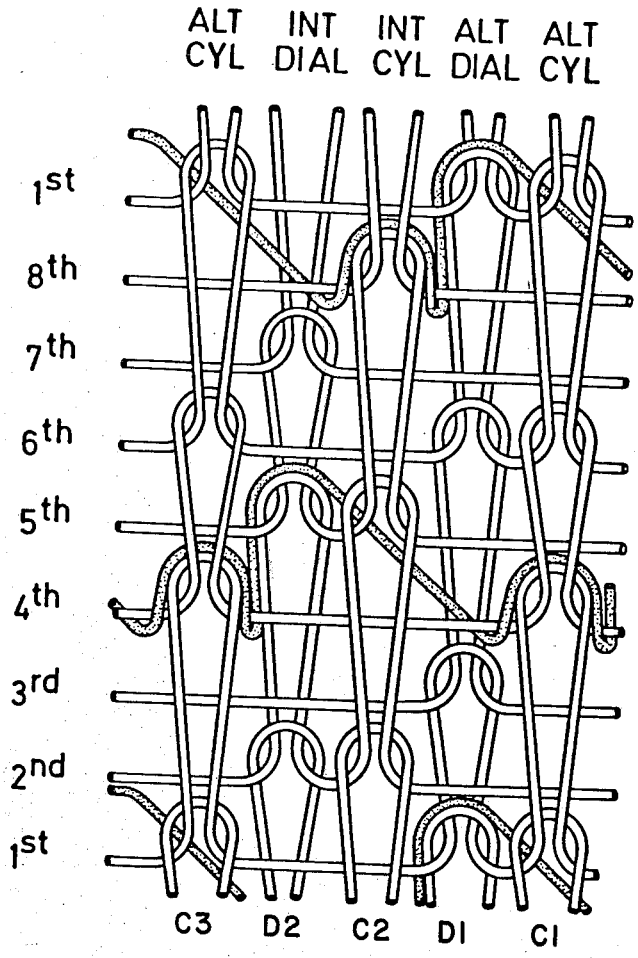
FIG. 6 is a stitch diagram of a fabric according to the invention.

The fabric produced in this way is one of many that can be knitted according to the invention and has a good body, with the inlay yarns holding it against undue weft-wise stretching. The fabric has the structure illustrated in FIG. 6 where the courses are numbered, cylinder wales are identified as C1, C2 and C3 and dial wales are identified as D1 and D2. It will be seen that the fabric is a double knit fabric in which knitted loops in cylinder wales C1, C2, etc. are drawn exclusively in a first direction (outwardly as shown in FIG. 6) while knitted loops in dial wales D1, D2, etc. are drawn in a second direction opposite to the first direction (inwardly as shown in FIG. 6). The yarns of some courses are drawn into knitted loops in both directions to form stitches on both faces of the fabric, e.g. the 1st, 2nd, 5th, and 6th courses in FIG. 6. In other courses, e.g. the 4th and 8th courses in FIG. 6, the yarns are drawn in the first direction only to from stitches on one face only of the fabric. In the 3rd and 7th courses shown in FIG. 6, the yarns are drawn in the second direction only to form stitches on the opposite face only. An inlay yarn, shown stippled in FIG. 6, is formed exclusively into tuck loops extending in both directions. In certain courses, e.g. the 4th and 8th courses, the body yarns drawn through the tuck loops form stitches on one face of the fabric, while in other courses, e.g. the 1st and 5th courses, the body yarns drawn through the tuck loops form stitches on the opposite face of the fabric.

It will be noted that the body yarns are drawn into knitted loops at selected wales only of the fabric and float past intervening wales. For example, in the 4th course, the yarn is knitted only in wales C1 and C3 and floats past wales D1, C2 and D2. Moreover the inlay yarn is formed into tuck loops at selected wales only of the fabric, and floats past intervening wales.

As illustrated by way of example in FIG. 6, the yarn of the 1st course is drawn into knitted loops at selected wales, some of the knitted loops extending to one face of the fabric and other knitted loops extending to the opposite face. The yarn of the 2nd course is drawn into knitted loops at selected wales other than those selected for the yarn of the first course. The 2nd course likewise includes knitted loops drawn to both faces of the fabric. The yarn of the 3rd course is drawn into knitted loops at selected wales, all of the knitted loops extending to a first face of the fabric. The yarn of the 4th course is drawn into knitted loops at selected wales, all of the knitted loops extending to the second face of the fabric. An inlay yarn, shown stippled in FIG. 6, is tucked at selected wales with those of knitted loops of the yarn of the 1st course which extend to only one face of the fabric and with those of the knitted loops of the yarn of the 2nd course, which extend to the opposite face of the fabric.

We claim:

1. Weft double knitted fabric having first and second faces, comprising:

a first yarn drawn into knitted loops at selected wales, the loops of the same course of the said first yarn extending to both faces of the fabric;

a second yarn drawn into knitted loops at selected wales other than those selected for the first yarn, the loops of the same course of the said second yarn extending to both faces of the fabric;

a third yarn drawn into knitted loops at selected wales, the loops of the same course of the said third yarn extending to the first face only of the fabric;

a fourth yarn drawn into knitted loops at selected wales, the loops of the same course of the said fourth yarn extending to the second face only of the fabric; and a fifth yarn tucked at selected wales in those of the knitted loops of the said first yarn which extend to only one of the said first and second faces of the fabric and in those of the knitted loops of the said second yarn which extend to only the other of said first and second faces of the fabric.

* * * * *